US008147002B2

(12) United States Patent
Chen et al.

(10) Patent No.: US 8,147,002 B2
(45) Date of Patent: Apr. 3, 2012

(54) BAMBOO CHAIR AND METHOD OF MANUFACTURING THE BAMBOO CHAIR

(75) Inventors: KaoMing Chen, Jhushan Township (TW); Konstantin Grcic, Munich (DE)

(73) Assignee: National Taiwan Craft Research Institute, Nantou County (TW)

( * ) Notice: Subject to any disclaimer, the term of this patent is extended or adjusted under 35 U.S.C. 154(b) by 442 days.

(21) Appl. No.: 12/483,784

(22) Filed: Jun. 12, 2009

(65) Prior Publication Data

US 2010/0264716 A1 Oct. 21, 2010

(30) Foreign Application Priority Data

Apr. 17, 2009 (TW) ..... 98112812 A

(51) Int. Cl.
*A47C 7/16* (2006.01)

(52) U.S. Cl. ..... 297/452.63; 297/451.3; 297/451.8

(58) Field of Classification Search ..... 297/452.63, 297/451.3, 451.4, 451.8, 440.14
See application file for complete search history.

(56) References Cited

U.S. PATENT DOCUMENTS

| | | | | | |
|---|---|---|---|---|---|
| 2,994,558 | A * | 8/1961 | Draxler | ..... | 297/451.8 |
| 3,743,353 | A * | 7/1973 | Lupinsky | ..... | 297/451.8 |
| 4,067,615 | A * | 1/1978 | Gehry | ..... | 297/451.8 |
| 4,235,473 | A * | 11/1980 | Aginar | ..... | 297/452.63 |
| 4,322,109 | A * | 3/1982 | Thebaud | ..... | 297/25 |
| 5,284,380 | A * | 2/1994 | Gehry | ..... | 297/451.9 |
| 6,824,221 | B1 * | 11/2004 | Tiffany et al. | ..... | 297/452.63 |

* cited by examiner

*Primary Examiner* — Anthony D Barfield
(74) *Attorney, Agent, or Firm* — Morris Manning & Martin LLP; Tim Tingkang Xia, Esq.

(57) ABSTRACT

The objective of the present invention is to provide a bamboo chair having a good load-carrying capacity and smooth shape and to provide a method of manufacturing the bamboo chair. The bamboo chair is sturdy, symmetrical and fashionable, has a center, a front, a rear and two sides and comprises multiple bamboo slats, a backrest, a seat, two legs and a base. The method of manufacturing a bamboo chair comprises steps of (A) preparing rough bamboo strips, (B) drying, (C) flattening, (D) finishing, (E) forming slat segments, (G) initial assembly, (I) interim assembly and (K) final assembly.

11 Claims, 8 Drawing Sheets

BAMBOO CHAIR AND METHOD OF MANUFACTURING THE BAMBOO CHAIR

FIELD OF THE INVENTION

The invention relates to a bamboo chair having a good load-carrying capacity and smooth shape and a method of manufacturing the bamboo chair.

BACKGROUND OF THE INVENTION

As gross domestic product (GDP) increases, people put more emphasis on a higher living standard and like products having artistic and fashionable shapes. People buying articles for daily use take into consideration whether the articles are durable or not, are practicable or not and have an artistic and fashionable shape or not.

With reference to FIG. 1, a conventional bamboo chair (2) with a fashionable and smooth shape was designed and manufactured, comprises multiple curved elements aligning with each other and has an upper rear curve (21), an upper front curve (22) and a lower front curve (23). However, the bamboo chair (2) cannot bear a large person's weight because the upper front curve (22) will break when a large person sits on the bamboo chair (2). When the upper front curve (22) breaks, a person sitting on the bamboo chair (2) will likely be injured. Consequently, the bamboo chair (2) is not durable and practical and is not a good chair even though it has a fashionable and smooth shape

SUMMARY OF THE INVENTION

The objective of the present invention is to provide a bamboo chair having a good load-carrying capacity and smooth shape and also provide a method of manufacturing the bamboo chair. The bamboo chair is sturdy, symmetrical and fashionable, has a center, a front, a rear and two sides and comprises multiple bamboo slats, a backrest, a seat, two legs and a base. The method of manufacturing a bamboo chair comprises steps of (A) preparing bamboo strips, (B) drying, (C) flattening, (D) finishing, (E) forming slat segments, (G) initial assembly, (I) interim assembly and (K) final assembly.

DETAILED DESCRIPTION OF THE PRESENT INVENTION

Figure 1:
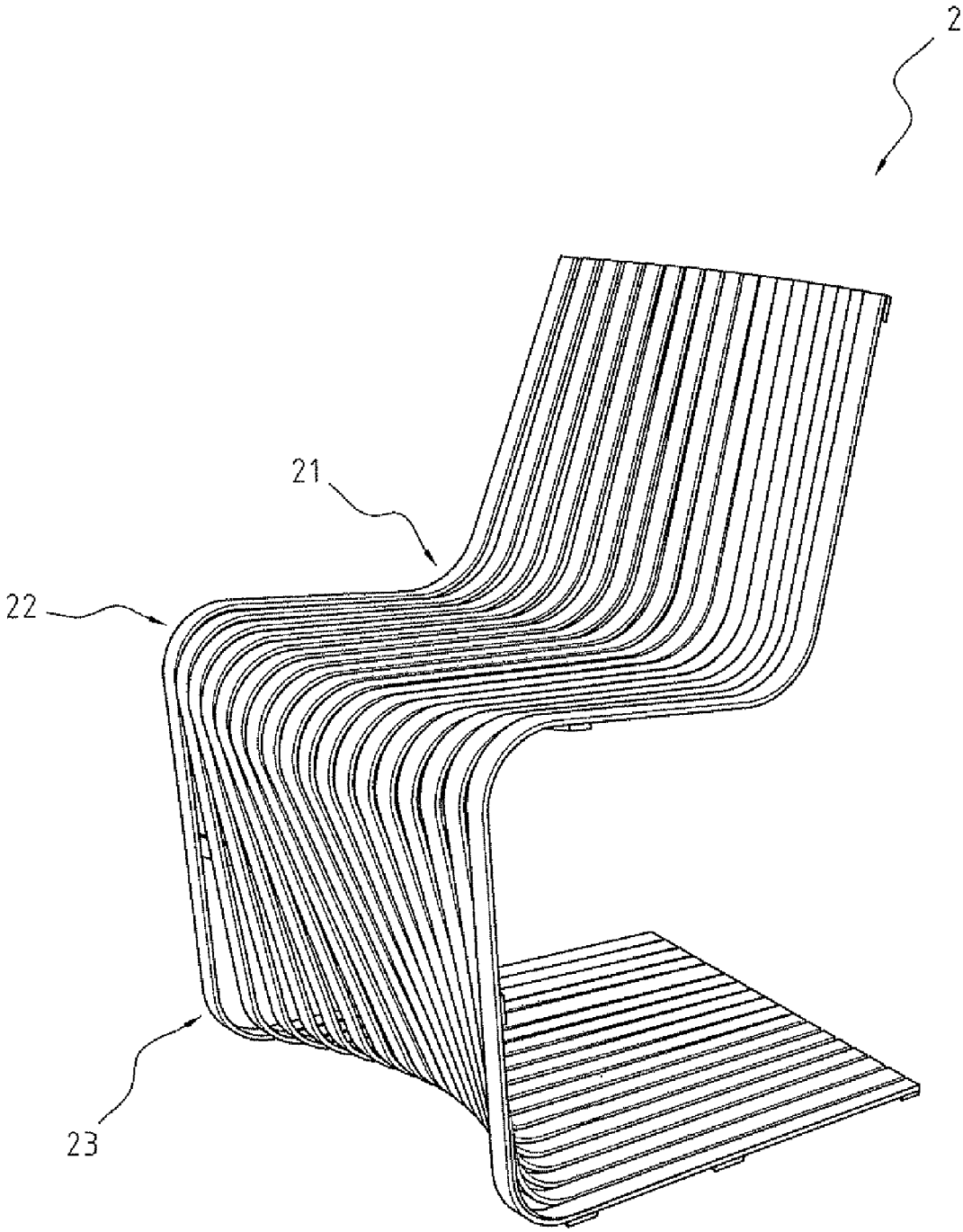
FIG. 1 is a conventional bamboo chair in accordance with the prior art.
Figure 2:
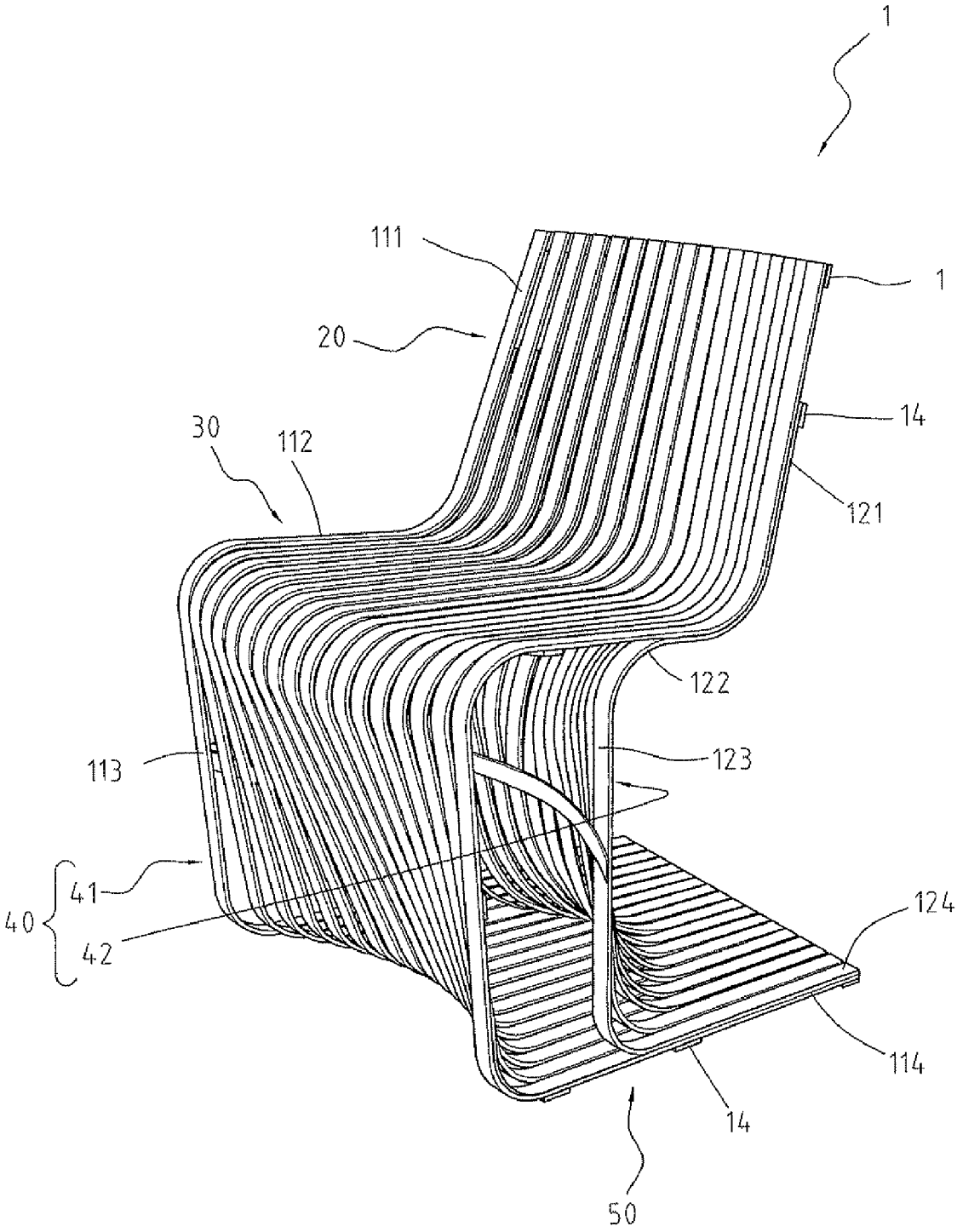
FIG. 2 is a front perspective view of a first embodiment of a bamboo chair in accordance with the present invention.
Figure 3:
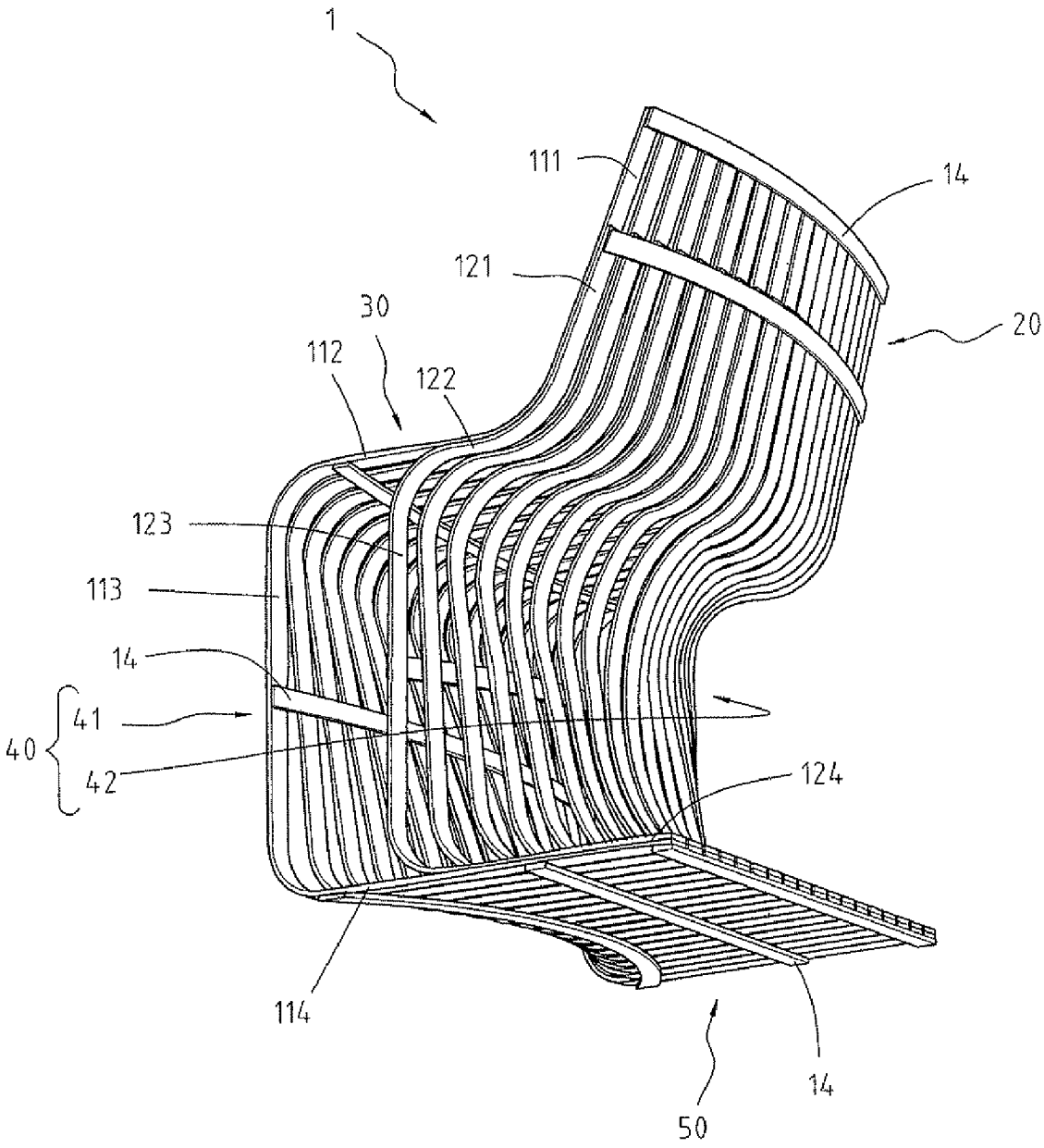
FIG. 3 is a rear perspective view of the bamboo chair in FIG. 2.
Figure 4:
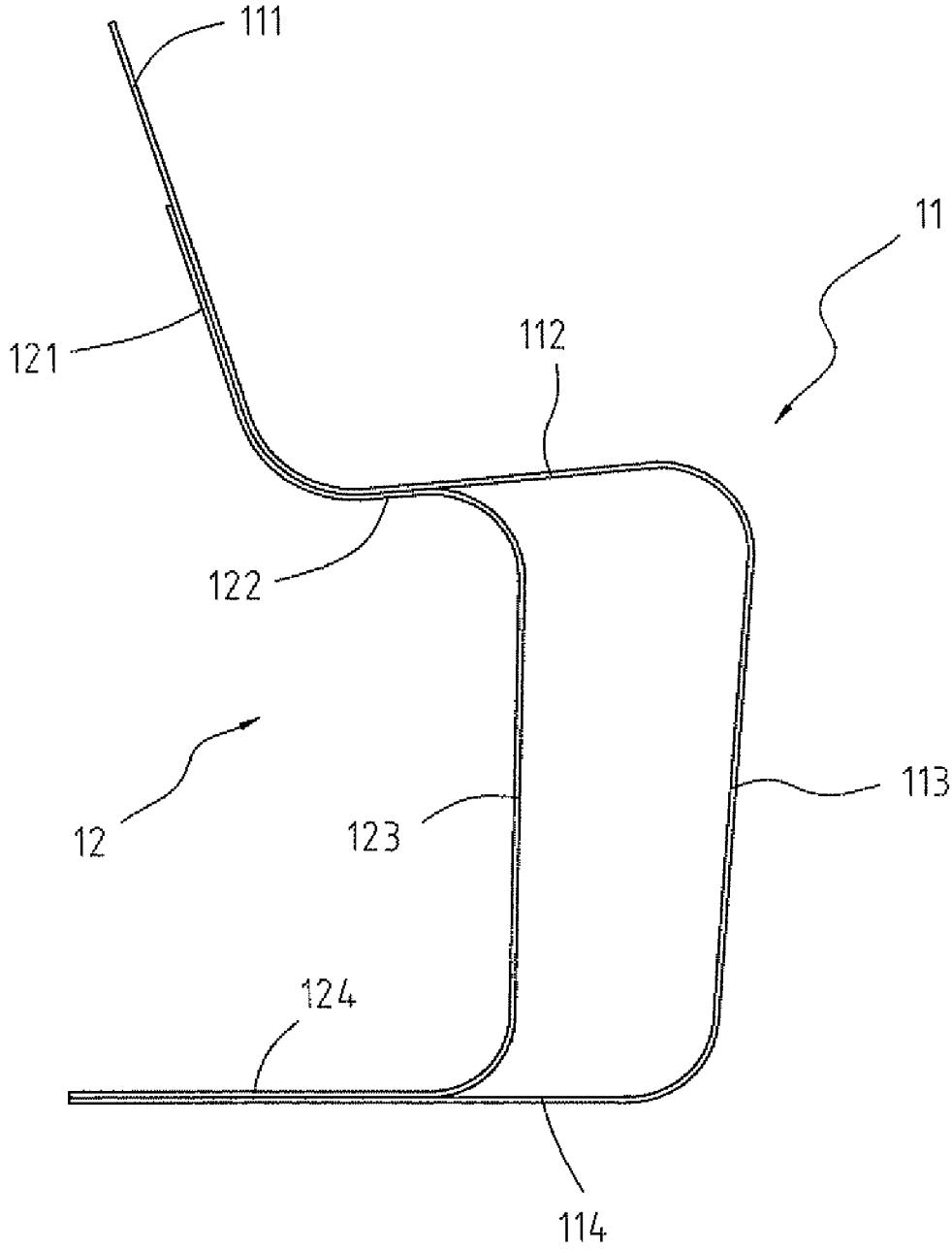
FIG. 4 is a side view of a pair of front and rear slat of the bamboo chair in FIG. 2.
Figure 5:
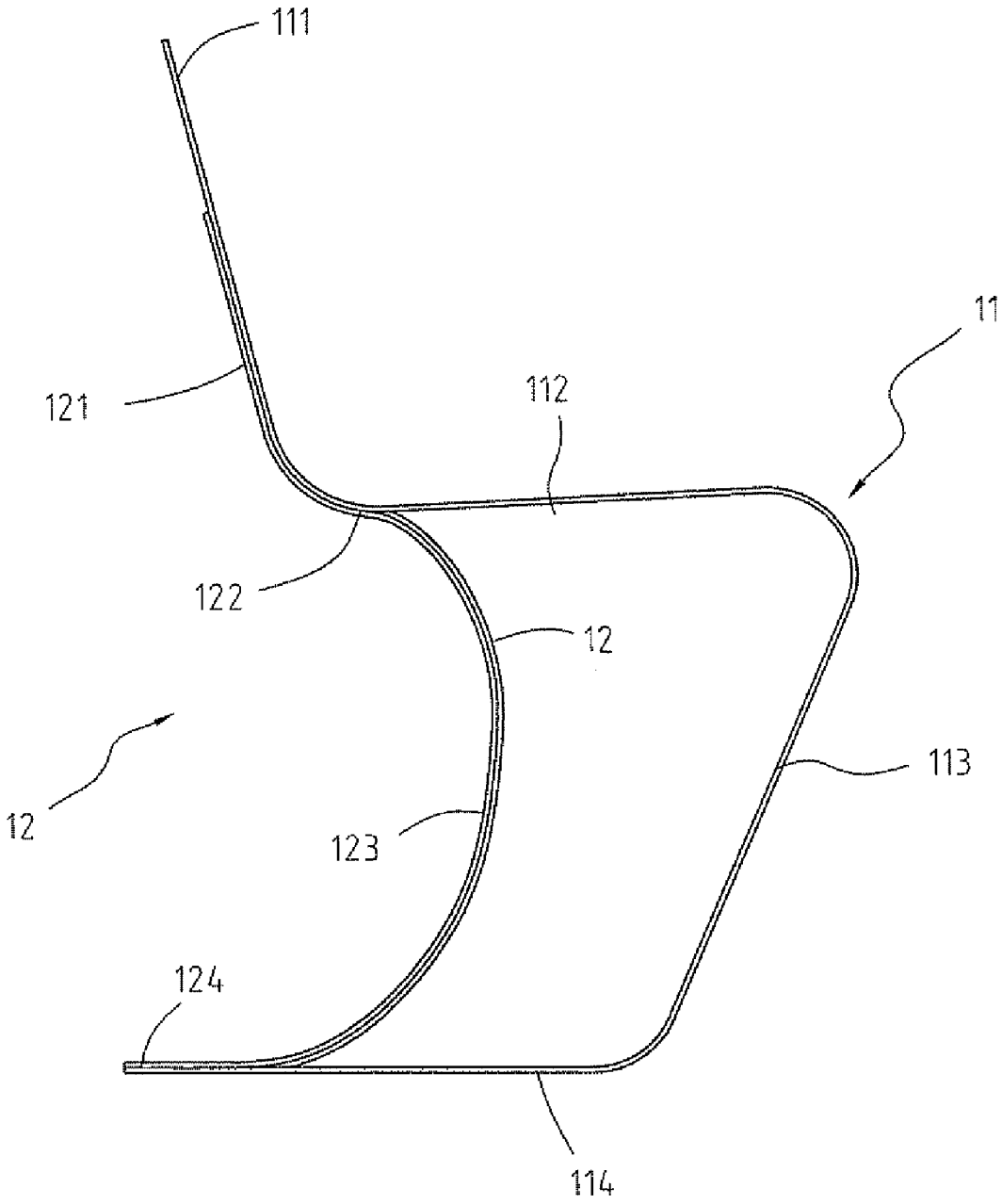
FIG. 5 is a side view of a pair of front and rear slat with a support slat of a second embodiment of a bamboo chair in accordance with the present invention.
Figure 6:
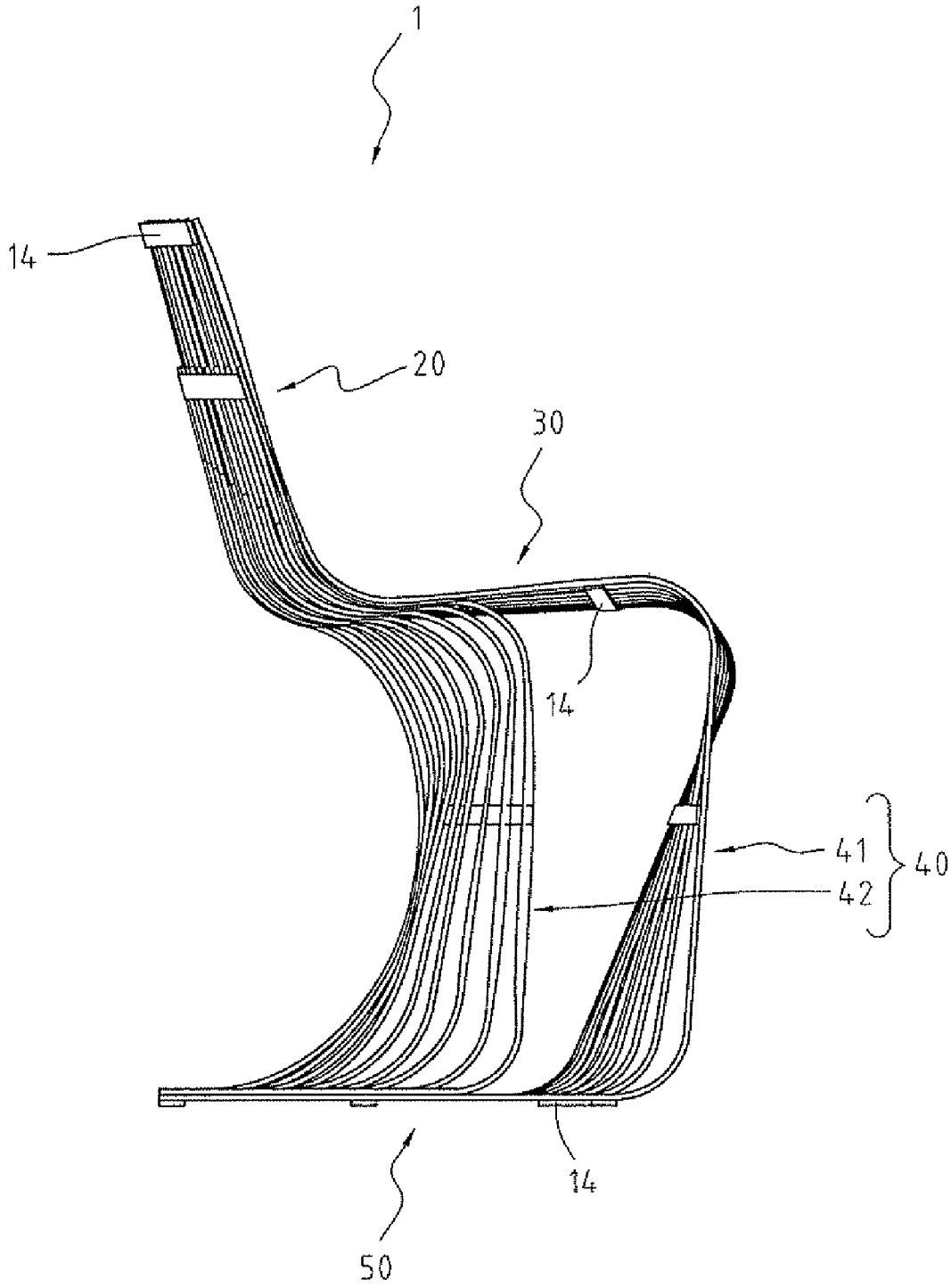
FIG. 6 is a side view of the bamboo chair in FIG. 2.
Figure 7:
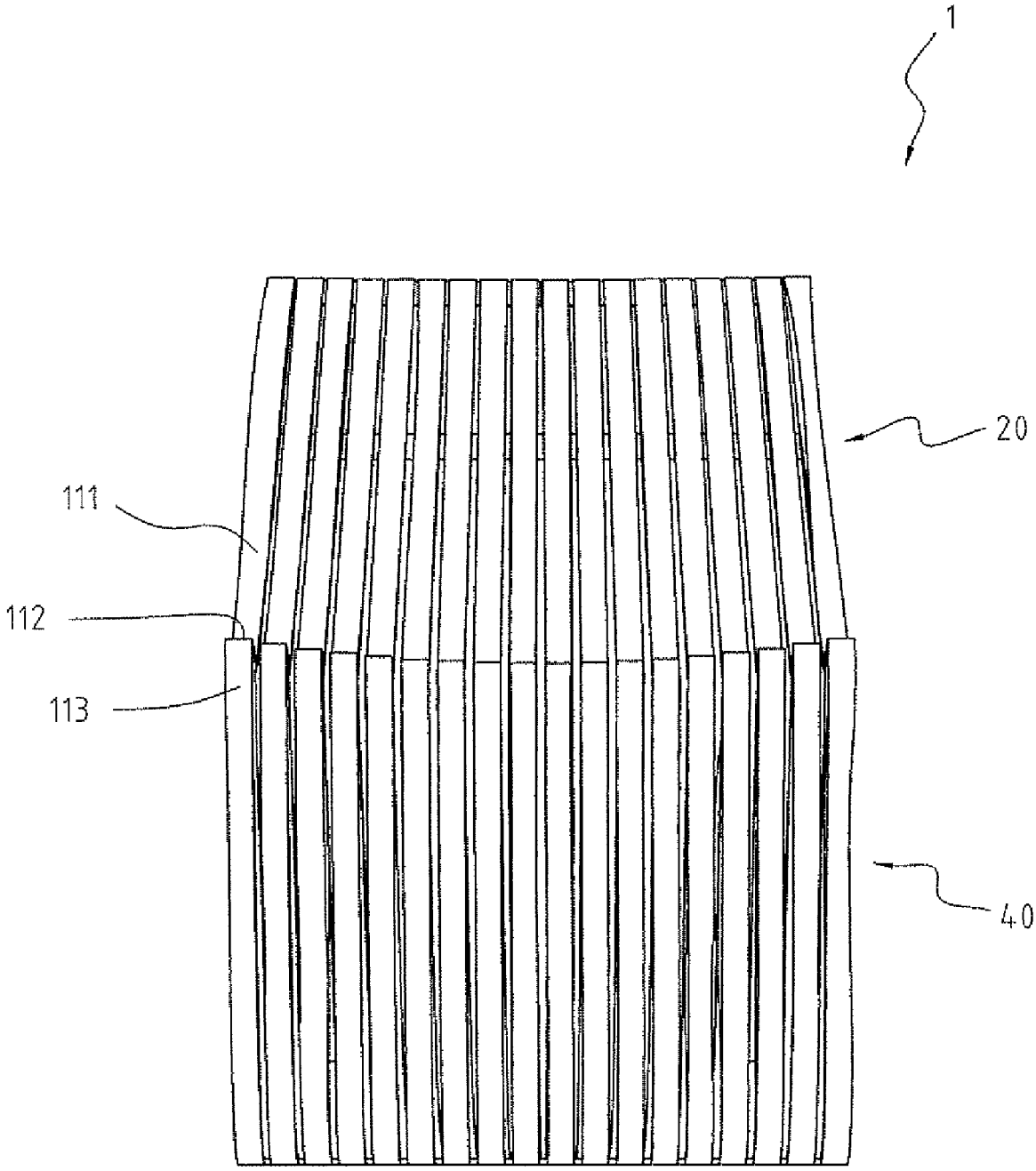
FIG. 7 is a front view of the bamboo chair in FIG. 2.
Figure 8:
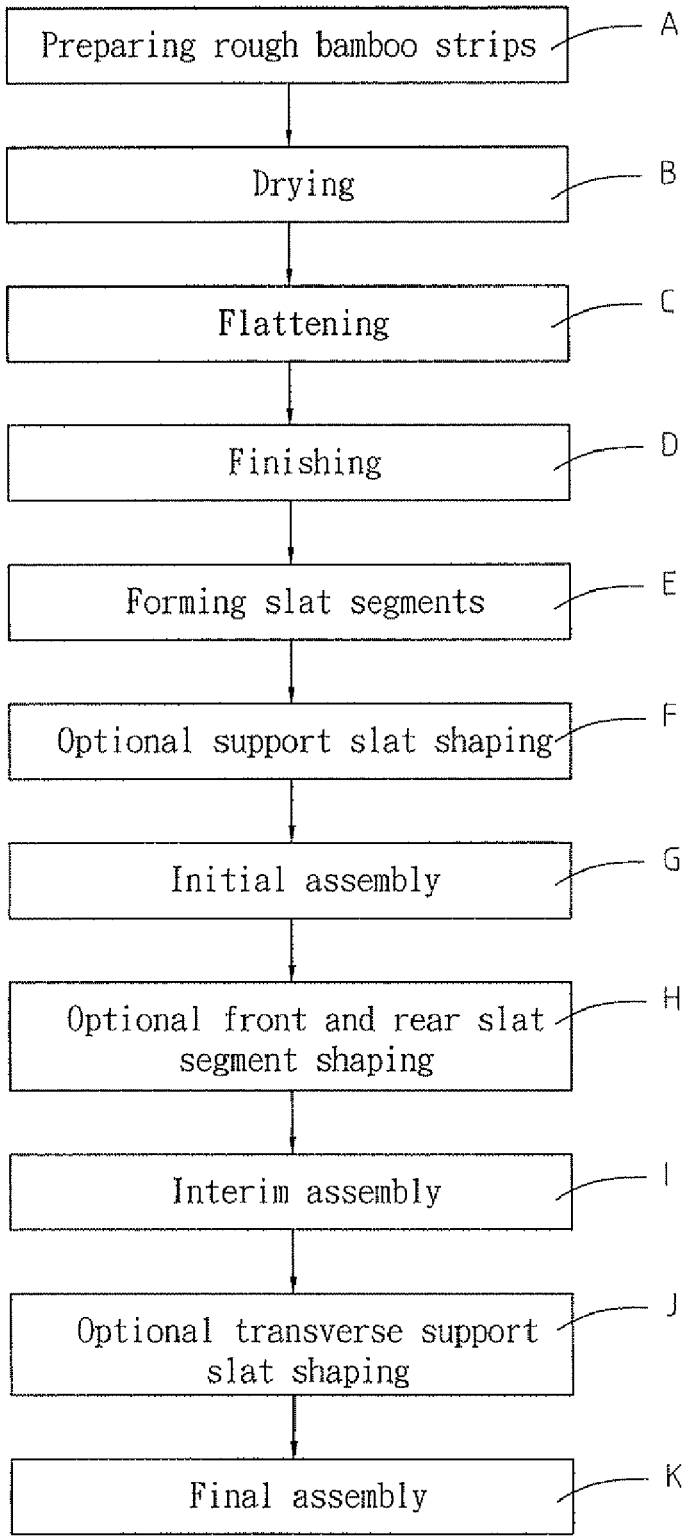
FIG. 8 is a functional block diagram of a method of manufacturing a bamboo chair in accordance with the present invention.

With reference to FIGS. 2, 5 and 8, the present invention relates to a sturdy, symmetrical and fashionable bamboo chair (1) and a method of manufacturing the bamboo chair (1).

With further reference to FIGS. 3, 4, 6 and 7, a bamboo chair (1) in accordance with the present invention is sturdy, symmetrical and fashionable, has a center, a front, a rear and two sides and comprises multiple bamboo slats, a backrest (20), a seat (30), two legs (40) and a base (50).

The bamboo slats are fundamental building blocks of the bamboo chair (1) and comprise multiple front slats (11), multiple rear slats (12), multiple optional longitudinal support slats (13) and multiple transverse support slats (14).

The front slats (11) are mounted adjacent to each other and have an upper end and a lower end, and each front slat (11) is curved and has a front surface, a rear surface, a backrest segment (111), a seat segment (112), a front leg segment (113) and a base segment (114).

The backrest segment (111) is formed at the upper end of the front slat (11) and has an upper end and a lower end.

The seat segment (112) extends from the lower end of the backrest segment (111), has a front end and a rear end, is at an angle to the backrest segment (111) and may be at an obtuse angle to the backrest segment (111).

The front leg segment (113) extends from the front end of the seat segment (112), protrudes downward, has an upper end and a lower end and may be at an acute angle to the seat segment (112).

The base segment (114) extends from the lower end of the front leg segment (113), bends parallel to a surface on which the bamboo chair (1) sits, has a front end and a rear end and may be at an obtuse angle with the front leg segment (113).

The rear slats (12) are mounted respectively on the rear surfaces of the front slats (11) to increase strength of the bamboo chair (1), and each rear slat (12) is curved and has an upper end, a lower end, a front surface, a rear surface, a backrest segment (121), a seat segment (122), a rear leg segment (123) and a base segment (124).

The a backrest segment (121) is formed at the upper end of the rear slat (12), may be shorter than the backrest segment (111) of the corresponding front slat (11), is connected to the rear surface of the front slat (11) on the corresponding backrest segment (111) and has an upper end and a lower end.

The seat segment (122) is shorter than the seat segment (112) of the front slat (11), extends from the lower end of the backrest segment (121) of the rear slat (12), connects to the rear surface of the front slat (11) on the corresponding seat segment (112) of the front slat (11), has a front end and a rear end, is at an angle to the backrest segment (121) and may be at an obtuse angle to the backrest segment (121).

The rear leg segment (123) extends from the front end of the seat segment (122), bends downward, is separated from the front leg segment (113) of the front slat (11) to increase load-bearing capacity and has an upper end and a lower end.

The base segment (124) extends from the lower end of the rear leg segment (123), bends to correspond to the rear end of the base segment (114) of the corresponding front slat (11) and connects to the base segment (114) of the corresponding front slat (11).

The optional longitudinal support slats (13) are curved, correspond to the rear leg segments (123) and are mounted respectively on the front surfaces of the rear slats (12) of the rear leg segments (123) between the seat segments (112) and base segments (114) of the corresponding front slats (11).

The transverse support slats (14) are mounted on and hold the front slats (11) and rear slats (12) securely in position adjacent to the corresponding front slats (11) and rear slats (12).

The backrest (20) is formed by the adjacent backrest segments (111, 121) respectively of the front and rear slats (11, 12) held in place by a transverse support slat (14) at upper ends of the front and rear slats (11, 12) or by two transverse support slats (14) respectively at upper ends of the front and rear slats (11, 12) when the backrest segments (121) of the rear slats (12) are shorter than the backrest segments (111) of the front slats (11) and may bend inwardly in a smooth and ergonomic recess for a person to sit comfortably on the bamboo chair (1).

The seat (30) is formed by the adjacent seat segments (112, 122) held in place by a transverse support slat (14) mounted under the seat (30) and may bend inwardly to form a smooth and ergonomic shape for a person to sit comfortably on the bamboo chair (1). The optional obtuse angles between the seat segments (112) and backrest segments (111) are smaller and smaller from the center toward sides of the bamboo chair (1) to form a recess in the seat (20) for a person's hips.

The legs (40) comprise a front leg (41) and a rear leg (42).

The front leg (41) is formed by the adjacent front leg segments (113) and may bend inwardly to form a smooth and ergonomic shape for a person to sit comfortably on the bamboo chair (1). The acute angles between the front leg segments (113) and the seat segments (112) are greater and greater from the center to sides of the bamboo chair (1) to form a recess in the front leg (41) for a person's legs.

The rear leg (42) is formed by the adjacent rear leg segments (123) such that separation of the rear leg segments (123) from the front leg segment (113) is shortest at the sides of the bamboo chair (1) and greatest at the center.

The base (50) is formed by the adjacent base segments (14, 124) held in place by at least two transverse support slats (14) and sits stably on any flat surface.

Personnel skilled in the art will understand that various changes, modifications and alterations in form and details may be made without departing from the spirit and scope of the invention, as claimed in the following claims.

A method of manufacturing a bamboo chair (1) in accordance with the present invention comprises steps of (A) preparing rough bamboo strips, (B) drying, (C) flattening, (D) finishing, (E) forming slat segments, (F) optional support slat shaping, (G) initial assembly, (H) optional front and rear slat segment shaping, (I) interim assembly, (J) optional transverse support slat shaping and (K) final assembly.

Step (A) of preparing rough bamboo strips comprises obtaining bamboo poles that are 10-12 centimeters in diameter, splitting the bamboo poles into bamboo strips of a desired width and removing internal and external projections from the bamboo strips to form rough bamboo strips.

Step (B) of drying comprises removing moisture from the rough bamboo strips to obtain dried rough bamboo strips. However, the drying process causes twists to form in the dried rough bamboo strips.

Step (C) of flattening comprises removing twists from and flattening the dried rough bamboo strips to form flattened rough bamboo strips.

Step (D) of finishing comprises removing rough external surfaces of the flattened rough bamboo strips to form bamboo slat stock of desired widths and thickness and cutting the bamboo slat stock to lengths as front, rear, longitudinal support and transverse support slats for manufacturing.

Step (E) of forming slat segments comprises forming a backrest segment (111, 121), a seat segment (112, 122), a leg segment (113, 123) and a base segment (114, 124) in each front slat (11) and each rear slat (12). The seat segments (112) of the front slats (11) may be at obtuse angles with the backrest segments (111) of the front slats (11). The obtuse angles between the seat segments (112) and backrest segments (111) are smaller and smaller from the center toward sides of the bamboo chair (1) to form a recess in the seat (30) to accommodate a person's hips. The leg segments (113) of the front slats (11) may be at an acute angle with the seat segments (112) of the front slats (11). The acute angles between the leg segments (113) and seat segments (112) of the front slats (11) are greater and greater from the center toward sides of the bamboo chair (1) to form a recess in the front leg (41) for a person's legs. The base segments (114) of the front slats (11) may be at an obtuse angle with the leg segments (113) of the front slats (11).

The optional step of (F) longitudinal support slat shaping comprises bending the longitudinal support slats (13) to correspond respectively to the rear legs (123) of the rear slats (12) to form multiple longitudinal support slats (13).

The step of (G) initial assembly comprises connecting the front slats (11) and rear slats (12) in pairs and optionally mounting the longitudinal support slats (13) respectively on the front surfaces of the rear slats (12) of the rear leg segments (123) between the seat segments (112) and base segments (114) of the corresponding front slats (11).

The optional step of (H) front and rear slat segment shaping comprises optionally twisting, optionally bending or both the backrest segments (111) of the front slats (11) and the backrest segments (121) of the rear slats (12), optionally twisting the seat segments (112) of the front slats (11), optionally twisting the front leg segments (113) of the front slats (11) and the rear leg segments (123) of the rear slats (12) to make them bend inward to form a smooth and ergonomic recess in the backrest (20) and the seat (30) for a person to sit comfortably on the bamboo chair (1).

The step of (I) interim assembly comprises mounting the assembled pairs of front and rear slats (11, 12) in a mounting jig to form a partial product.

The optional step of (J) transverse support slat shaping comprises bending the transverse support slats (14) to conform to the recesses.

The step of (K) final assembly comprises mounting the transverse support slats (14) on the backrest segments (111, 121) and rear surfaces of the front and rear slats (11, 12) at the upper ends, under the seat segments (112) on the rear surfaces of the front slats (11), behind the front leg segments (113) on rear surfaces of the front slats (11), on the rear leg segments (123) and front surfaces of the rear slats (12) and under the base segments (114) and on the front surfaces of the front slats (11) to form the bamboo chair (1).

Personnel skilled in the art will understand that various changes, modifications and alterations may be made in the foregoing method without departing from the spirit and scope of the invention, as claimed in the following claims.

What is claimed is:

1. A bamboo chair being sturdy, symmetrical and fashionable, having a center, a front, a rear and two sides and comprising;

multiple bamboo slats being fundamental building blocks of the bamboo chair and comprising;

multiple front slats being mounted adjacent to each other and having an upper end and a lower end, and each front slat being curved and having;

a front surface;

a rear surface;

a backrest segment being formed at the upper end of the front slat and has an upper end and a lower end;

a seat segment extending from the lower end of the backrest segment, having a front end and a rear end and being at an angle to the backrest segment;

a front leg segment extending from the front end of the seat segment, protruding downward and having an upper end and a lower end; and a base segment extending from the front leg segment, bending parallel to a surface on which the bamboo chair sits and having a front end and a rear end;

multiple rear slats being mounted respectively on the rear surfaces of the front slats, and each rear slat being curved and having an upper end;

a lower end;

a front surface;

a rear surface;

a backrest segment being formed at the upper end of the rear slat, being connected to the rear surface of the front slat on the corresponding backrest segment and having an upper end and a lower end;

a seat segment being shorter than the seat segment of the front slat, extending from the lower end of the backrest segment of the rear slat, connecting to the rear surface of the front slat on the corresponding seat segment of the front slat, having a front end and a rear end and being at an angle to the backrest segment;

a rear leg segment extending from the front end of the seat segment, bending downward, being separated from the front leg segment of the front slat and having an upper end and a lower end;

a base segment extending from the lower end of the rear leg segment, bending to correspond to the rear end of the base segment of the corresponding front slat and connecting to the base segment of the corresponding front slat; and multiple transverse support slats being mounted on and holding the front slats and rear slats securely in position adjacent to the corresponding front slats and rear slats;

a backrest being formed by the adjacent backrest segments respectively of the front and rear slats held in place by a transverse support slat at upper ends of the front and rear slats;

a seat being formed by the adjacent seat segments held in place by a transverse support slat mounted under the seat;

two legs comprising;

a front leg being formed by the adjacent front leg segments;

a rear leg being formed by the adjacent rear leg segments; and a base being formed by the adjacent base segments held in place by at least two transverse support slats and sitting stably on any flat surface.

2. The bamboo chair as claimed in claim 1, wherein the bamboo slats further comprise multiple longitudinal support slats being curved, corresponding to the rear leg segments and being mounted respectively on the front surfaces of the rear slats of the rear leg segments between the seat segments and base segments of the corresponding front slats.

3. The bamboo chair as claimed in claim 2, wherein the support slats being curved, corresponding to the rear leg segments and being mounted respectively on the front surfaces of the rear slats of the rear leg segments between the seat segments and base segments of the corresponding front slats.

4. The bamboo chair as claimed in claim 1, wherein the seat segment of the front slat is at an obtuse angle to the backrest segment; and the seat segment of the rear slat is at an obtuse angle to the backrest segment.

5. The bamboo chair as claimed in claim 4, wherein the obtuse angles between the seat segments and backrest segments are smaller and smaller from the center toward sides of the bamboo chair to form a recess in the seat for a person's hips.

6. The bamboo chair as claimed in claim 1, wherein the front leg segment is at an acute angle to the seat segment.

7. The bamboo chair as claimed in claim 6, wherein the acute angles between the front leg segments and the seat segments are greater and greater from the center to sides of the bamboo chair to form a recess in the front leg for a person's legs.

8. The bamboo chair as claimed in claim 1, wherein the base segment is at an obtuse angle with the front leg segment.

9. The bamboo chair as claimed in claim 1, wherein the backrest segment of the rear slat is shorter than the backrest segment of the corresponding front slat; and the adjacent backrest segments respectively of the front and rear slats are held in place by two transverse support slats respectively at upper ends of the front and rear slats.

10. The bamboo chair as claimed in claim 1, wherein each rear slat further comprises support slats being curved, corresponding to the rear leg segments and being mounted respectively on the front surfaces of the rear slats of the rear leg segments between the seat segments and base segments of the corresponding front slats.

11. The bamboo chair as claimed in claim 1, wherein the backrest bends inwardly in a smooth and ergonomic recess for a person to sit comfortably on the bamboo chair;

the seat bends inwardly to form a smooth and ergonomic shape for a person to sit comfortably on the bamboo chair; and the front leg bends inwardly to form a smooth and ergonomic shape for a person to sit comfortably on the bamboo chair.

* * * * *